US008412065B2

(12) United States Patent
Shiraki et al.

(10) Patent No.: US 8,412,065 B2
(45) Date of Patent: Apr. 2, 2013

(54) IMAGE FORMING APPARATUS WITH DEVELOPING ROLLER CLEANING CAPABILITY

(75) Inventors: Masatoshi Shiraki, Nagoya (JP); Hiroshi Handa, Nagoya (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 574 days.

(21) Appl. No.: 12/607,128

(22) Filed: Oct. 28, 2009

(65) Prior Publication Data

US 2010/0111552 A1 May 6, 2010

(30) Foreign Application Priority Data

Oct. 31, 2008 (JP) ..... 2008-281990

(51) Int. Cl.
*G03G 15/06* (2006.01)

(52) U.S. Cl. ..... 399/55; 399/25; 399/119; 399/149

(58) Field of Classification Search ..... 399/25, 399/55, 107, 11, 53, 119, 149, 348
See application file for complete search history.

(56) References Cited

U.S. PATENT DOCUMENTS

| | | | | |
|---|---|---|---|---|
| 5,965,312 | A | 10/1999 | Nakazawa et al. | |
| 6,041,208 | A * | 3/2000 | Choi | 399/281 |
| 6,466,760 | B2 | 10/2002 | Mizuno | |
| 6,751,423 | B2 * | 6/2004 | Sakaizawa et al. | 399/55 |
| 2001/0055502 | A1 | 12/2001 | Mizuno | |

FOREIGN PATENT DOCUMENTS

| | | |
|---|---|---|
| JP | 03-084569 | 4/1991 |
| JP | 05-011599 | 1/1993 |
| JP | 05-265313 | 10/1993 |
| JP | 05-313472 | 11/1993 |
| JP | 06-118785 | 4/1994 |
| JP | 06-222656 | 8/1994 |
| JP | 09-160375 | 6/1997 |
| JP | 10-026841 A | 1/1998 |
| JP | 11-212360 A | 8/1999 |

(Continued)

OTHER PUBLICATIONS

JP Office Action dtd Sep. 7, 2010, JP Appln. 2008-281990, English Translation.
Decision of Rejection mailed Dec. 7, 2010 in Japanese Application No. 2008-281990 and partial English translation thereof.
Examiner's Opinion mailed May 31, 2011 in Japanese Appeal No. 2011-4872 for Patent Application No. 2008-281990 and English translation thereof.

*Primary Examiner* — Walter L Lindsay, Jr.
*Assistant Examiner* — Roy Y Yi
(74) *Attorney, Agent, or Firm* — Banner & Witcoff, Ltd.

(57) ABSTRACT

An image forming apparatus includes a photosensitive member, a developing roller, a toner supply roller, and a charging member. The toner supply roller supplies single-component non-magnetic toner to the developing roller for developing a latent image formed on the photosensitive drum. In a toner cleaning mode, the toner supply roller removes the toner from the developing roller. To this effect, the charging member charges up the toner held on the developing roller. A bias circuit and a controller are further provided, wherein the bias circuit applies bias voltages to the developing roller, supply roller, and charging member, and the controller controls the bias circuit to produce the bias voltages such that a potential difference between the charging member and the supply roller is greater than a potential difference between the developing roller and the supply roller in the toner cleaning mode.

12 Claims, 2 Drawing Sheets

FOREIGN PATENT DOCUMENTS

| | | |
|---|---|---|
| JP | 2000-066495 | 3/2000 |
| JP | 2000-250376 | 9/2000 |
| JP | 2001-337521 A | 12/2001 |
| JP | 2007-232990 | 9/2007 |

* cited by examiner

IMAGE FORMING APPARATUS WITH DEVELOPING ROLLER CLEANING CAPABILITY

CROSS REFERENCE TO RELATED APPLICATION

This application claims priority from Japanese Patent Application No. 2008-281990 filed Oct. 31, 2008. The entire content of the priority application is incorporated herein by reference.

TECHNICAL FIELD

The present invention relates to an electrophotographic image forming apparatus, and more particularly to removal of toner accumulated on a developing roller.

BACKGROUND

An electrophotographic image forming apparatus includes a photosensitive drum, a developing roller, and a toner supply roller. Toner accommodated in a toner container is conveyed to the developing roller by the toner supply roller, and an electrostatic latent image formed on the photosensitive drum is developed with the toner supplied by the developing roller. All the toner supplied to the developing roller is not used for the development of the latent image but a part of the toner remains unused in the developing roller. A long-term use of the apparatus results in accumulation of the unused toner on the developing roller.

Hence, it has been proposed to perform toner cleaning operations for the developing roller to remove the toner accumulated thereon. The cleaning operations are performed whenever the apparatus is powered and/or after making a predetermined number of copies. It has also been proposed that the toner cleaning operation for negatively charged toner be performed by applying a bias voltage ranging from +100 to +500 V to the supply roller. With such a toner cleaning operation, the toner supply roller can remove the toner accumulated on the developing roller.

SUMMARY

The present inventors have found that the removal of the accumulated toner from the developing roller cannot be perfectly accomplished with the conventional approach. The inventors considered that such imperfect removal of the accumulated toner results from the behavior of an additive deposited on the surface of the toner for the purpose of improving fluidity. The inventors have found that additive is peeled off from the toner due to friction generated when the accumulated toner is in slidable contact with the toner supply roller. It is considered that only the additive remains and is accumulated on the developing roller while the toner with no additive is removed from the developing roller.

In view of the foregoing, it is an object of the invention to provide an image forming apparatus that can perfectly achieve the toner cleaning operation for removing the accumulated toner on the developing roller.

In order to attain the above and other objects, the invention provides an image forming apparatus that includes a photosensitive member, a developing roller, a toner supply roller, a charging member, a bias circuit, and a controller. The photosensitive member has a surface on which a latent image is formable. The developing roller has a surface on which toner is held. The toner is made of a single-component non-magnetic material. The toner supply roller is disposed in contact with the developing roller, and supplies the toner to the developing roller in a developing mode. In the developing mode, the developing roller develops the latent image with the toner held on the developing roller. The toner supply roller collects the toner from the developing roller in a toner cleaning mode. In the toner cleaning mode, the toner supply roller collects the toner held on the developing roller. The charging member is provided for charging the toner held on the developing roller to a first polarity. The bias circuit applies bias voltages to the developing roller, the supply roller, and the charging member. The controller is configured to control the bias circuit to produce the bias voltages such that a potential difference between the charging member and the supply roller is greater than a potential difference between the developing roller and the supply roller in the toner cleaning mode.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
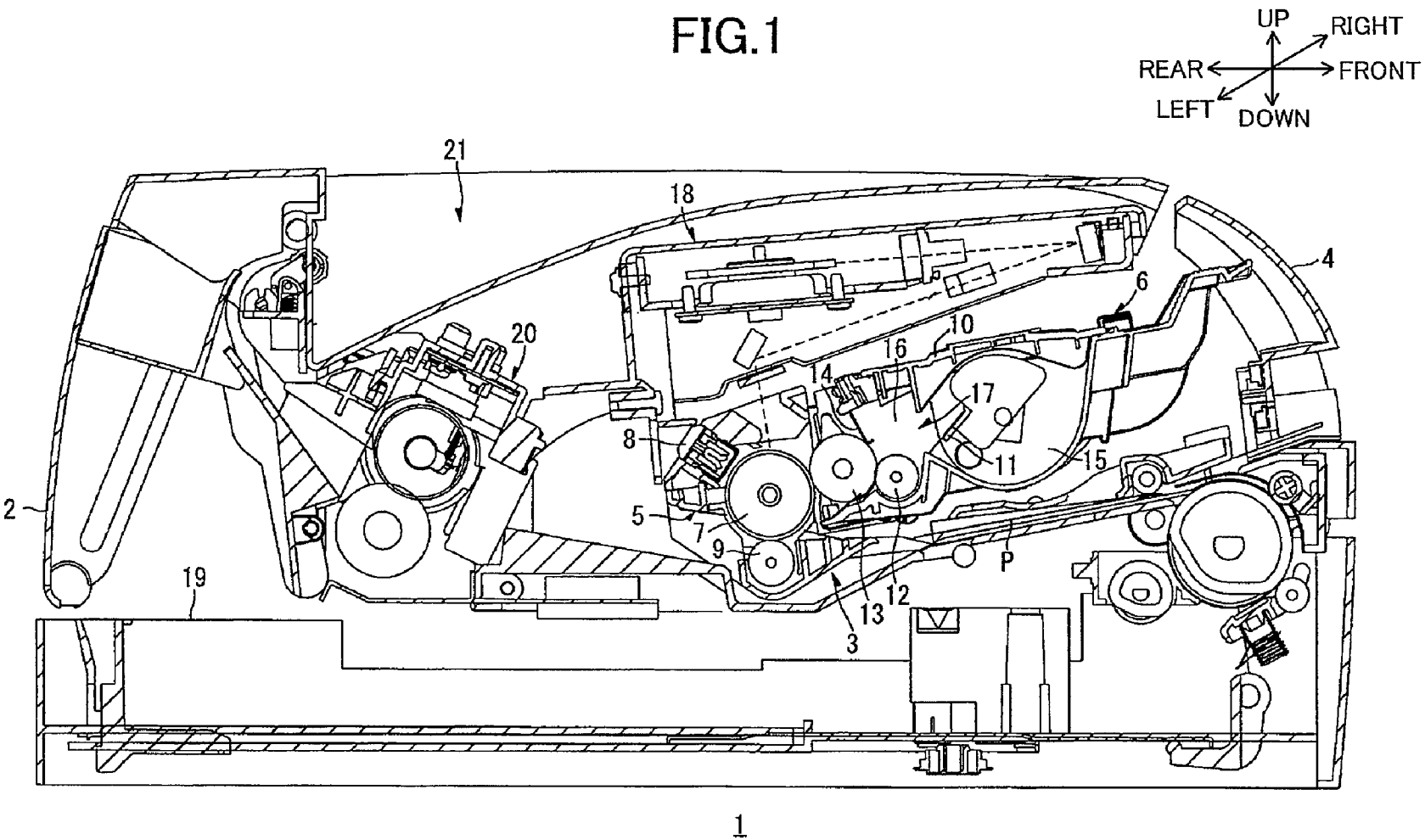
FIG. 1 is a vertical cross-sectional view showing a laser printer according to an embodiment of the invention.

Referring to the accompanying drawings, a laser printer 1, one of the image forming apparatuses, will be described. First, the general configuration thereof will be described with reference to FIG. 1. Note that, in the following description, orientations are referred to assuming that the laser printer 1 is disposed in an orientation in which it is intended to be used. Specifically, the right side of the laser printer 1 in FIG. 1 will be referred to as the "front side," and the left side thereof as the "rear side." Also, the near side in FIG. 1 with respect to the paper width direction will be referred to as the "left side," and the far side as the "right side."

The laser printer 1 has a main housing 2 in which a process cartridge 3 is disposed. The process cartridge 3 is mountable in and detachable from the main housing 2 through an opening which appears when a front cover 4 is open. The process cartridge 3 includes a drum cartridge 5 and a developing cartridge 6 detachably mounted on the drum cartridge 5. A photosensitive drum 7 is rotatably disposed in the drum cartridge 5. A Scorotron charger 8 and a transfer roller 9 are disposed in the periphery of the photosensitive drum 7.

The developing cartridge 6 has a cartridge housing 10 in which a toner-accommodating chamber 15 and a developing chamber 16 are arranged in the front-to-rear direction. The toner-accommodating chamber 15 and the developing chamber 16 are in communication with each other through a communication port 17 to allow toner to pass therethrough. Single-component non-magnetic toner (developing agent) that is positively charged is contained in the toner-accommodating chamber 15. An additive, such as silica, titanium oxide, is deposited on the surface of the toner to improve fluidity. The additive is made from a material that can be charged to a polarity opposite to the polarity of the charged toner. That is, the additive is negatively chargeable.

An agitator 11 is rotatably disposed in the toner-accommodating chamber 15 for agitating the toner. A toner supply roller 12 is rotatably disposed behind or in the rear side of the communication port 17. The developing roller 13 and the toner supply roller 12 are in peripheral contact with each other. A part of the periphery of the developing roller 13 protrudes from the cartridge housing 10 and is in slidable contact with the photosensitive drum 7.

A toner thickness regulating blade 14 is provided within the developing chamber 16 for regulating the thickness of the toner held on the peripheral surface of the developing roller 13. The regulating blade 14 is made from a metal and is an elongated plate-like shape extending in the left-to-right direction. The base portion of the regulating blade 14 is fixed to the cartridge housing 10 while the free end thereof is bent and extends to a direction away from the developing roller 13. The bent portion is in pressure contact with the peripheral surface of the developing roller 13.

Rotations of the agitator 11 agitate the toner in the toner-accommodating chamber 15 and convey the toner toward the developing chamber 16 via the communication port 17. The toner conveyed to the developing chamber 16 is supplied to the developing roller 13 via the toner supply roller 12. The toner held on the peripheral surface of the developing roller 13 is regulated by the toner thickness regulating blade 14 to have a predetermined thickness.

A scanner unit 18 is disposed above the process cartridge 3. A sheet feed cassette 19 is disposed in the bottom of the main casing 2. Sheets of paper P are accommodated in the sheet feed cassette 19 in a stacked state.

In the main casing 2, a fixing unit 20 is disposed behind or at the rear side of the process cartridge 3.

In operation, as the photosensitive drum 7 rotates, the peripheral surface of the photosensitive drum 7 is uniformly charged by the Scorotron charger 8 and then exposed to a laser beam emitted from the scanner unit 18. The laser beam is modulated based on image data. As a consequence, an electrostatic latent image corresponding to the image data is formed on the surface of the photosensitive drum 7. As the photosensitive drum 7 further rotates, the electrostatic latent image is brought to the position of the developing roller 13. The developing roller 13 supplies the toner to the electrostatic latent image to thereby form a toner image thereon.

The uppermost sheet P on the sheet feed cassette 19 is fed by sheet feed rollers to a transfer position between the photosensitive drum 7 and the transfer roller 9. The toner image on the photosensitive drum 7 is transferred onto the sheet of paper P by virtue of the transfer roller 9 to which a predetermined bias voltage is applied.

The sheet of paper P on which the toner image is transferred is conveyed to the fixing unit 20. The toner image on the sheet of paper P is thermally fixed by the heat and pressure applied thereto by the fixing unit 20. The sheet of paper P on which the toner image is fixed is further conveyed by another sheet feed rollers onto a discharge tray 21 formed on the upper surface of the main casing 2.

Figure 2:
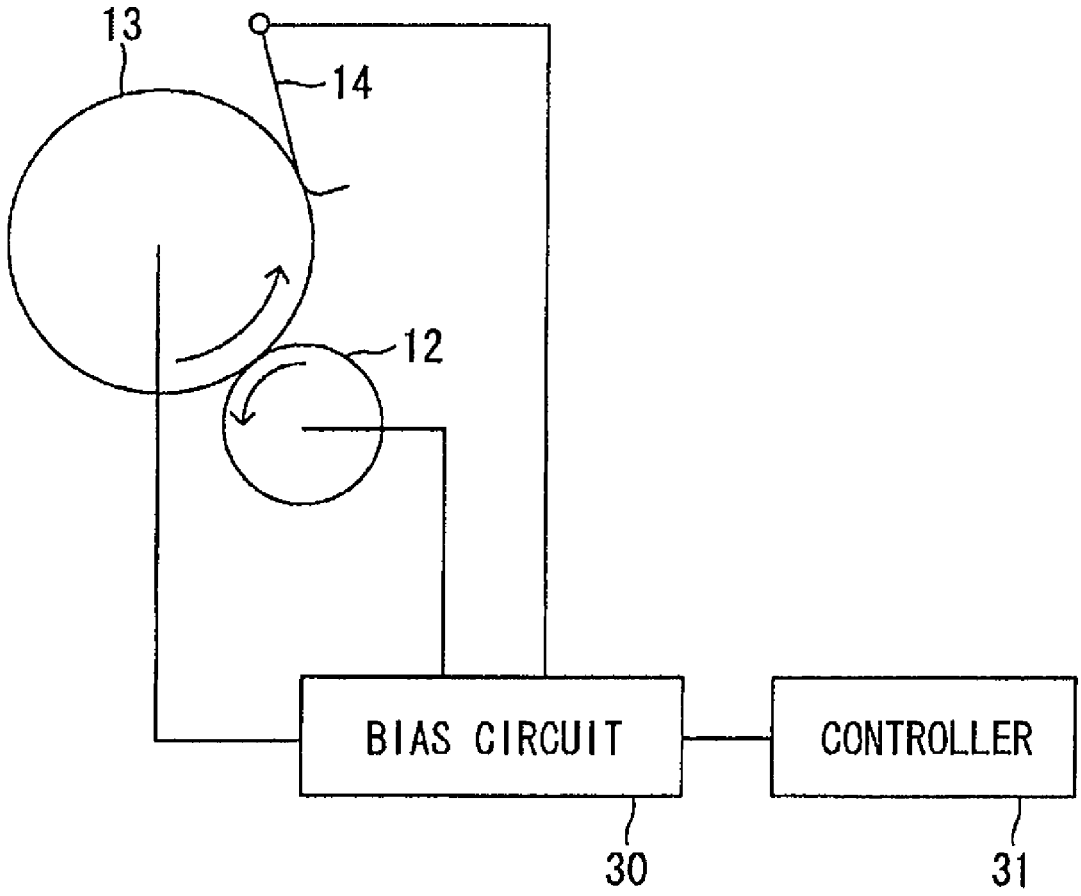
FIG. 2 is an explanatory diagram showing an electrical arrangement of a process cartridge.

As shown in FIG. 2, a bias circuit 30 is provided in the process cartridge 3 to apply a relevant bias voltage to each of the toner supplying roller 12, developing roller 13, and thickness regulating blade 14. A controller 31 is connected to the bias circuit 30.

More specifically, the bias circuit 30 is configured from a plurality of circuit units each provided in association with the toner supplying roller 12, developing roller 13, and thickness regulating blade 14. The controller 31 is configured from a microcomputer and is connected to the bias circuit 30 to separately apply control signals to the circuit units. Configuration of each of the circuit units is well known in the art, so detail description thereof is omitted herein. Briefly, the circuit unit provided for the thickness regulating blade 14 is configured from a first rectifying/smoothing circuit connected to an AC power supply, a transformer, a switching element, such as FET, connected between the first rectifying/smoothing circuit and the primary winding of the transformer, and a second rectifying/smoothing circuit connected to the secondary winding of the transformer. The control signal from the controller 31 is applied to the gate of the FET so that a relevant bias voltage is generated from the output of the second rectifying/soothing circuit in response to the control signal.

The laser printer 1 is operable with either a developing mode or a toner cleaning mode. As will be described hereinafter, the bias voltages applied to the developing roller 13 and the thickness regulating blade 14 are changed depending upon the mode set to the laser printer 1.

<Developing Mode>

The developing mode is for forming a toner layer on the surface of the developing roller 13 so that the electrostatic latent image formed on the photosensitive drum 7 is developed with the toner supplied from the developing roller 13. In the developing mode, the bias circuit 30 applies bias voltage of +400 V to the developing roller 13, and also applies bias voltage of +400 V (same as the bias voltage applied to the developing roller 13) to both the toner supply roller 12 and the thickness regulating blade 14.

The toner supply roller 12 and the developing roller 13 rotate in the same direction as shown by arrows in FIG. 2. The toner held on the toner supply roller 12 is frictionally charged to negative polarity at the portion where the toner supply roller 12 and the developing roller 13 are in contact with each other. The positively charged toner is attracted to the developing roller 13. As the developing roller 13 rotates, the thickness of the toner on the developing roller 13 is regulated to have a prescribed thickness by virtue of the thickness regulating blade 14.

<Toner Cleaning Mode>

The toner cleaning mode is for removing the toner remaining on the developing roller 13 and receiving the removed toner at the toner supply roller 12. The toner cleaning operation is automatically implemented whenever the laser printer 1 is powered, after making a predetermined number of copies, for example 1000 copies or after completion of a series of predetermined jobs.

The same developing bias (for example, +400 V) as applied to the developing roller 13 in the developing mode is also applied to the developing roller 13 in the toner cleaning mode. A predetermined blade bias is applied to the thickness regulating blade 14. In this embodiment, the blade bias is set, for example, to +600 V. The toner supply roller 12 is connected to ground, thus the potential thereof being held 0 V. The polarity of the blade bias is the same as that of the developing bias. Further, the potential difference between the thickness regulating blade 14 and the toner supply roller 12 is set to be greater than the potential difference between the developing roller 13 and the toner supply roller 12.

Accordingly, the toner held on the developing roller 13 is positively charged to have higher potential than the developing roller 13 by virtue of the blade bias applied to the thickness regulating blade 14. It should be noted that the thickness regulating blade 14 is used not only for regulating the thickness of the toner held on the developing roller 13 but also for charging the toner. That is, the thickness regulating blade 14 operates as a charging member for charging the toner to positive polarity. The toner charged by the charging member (thickness regulating blade) 14 is then attracted to the toner supply roller 13 due to the potential difference between developing bias applied to the developing roller 13 and the potential (0 V) of the toner supply roller 12. At this time, the potential difference between the blade bias (+600 V) applied to the thickness regulating blade 14 and the potential (0 V) on the toner supply roller 12 is set to be greater than the potential difference between the developing bias (+400 V) applied to the developing roller 13 and the potential (0 V) on the toner supply roller 12. Consequently, electrostatic attracting force imparted upon the toner by the toner supply roller 12 is greater than the attracting force generated by the developing roller 13. The toner then releases from the developing roller 13 and attracted to the toner supply roller 12. In this manner, the toner adhered to the developing roller 13 can be removed and collected to the toner supply roller 12.

Not only in the developing mode but also in the toner cleaning mode, the bias circuit 30 applies the developing bias to the developing roller 13. In the toner cleaning mode, the blade bias applied to the thickness regulating blade 14 is greater in absolute value than the developing bias. Application of the blade bias to the thickness regulating blade 14 can charge up the toner on the developing roller 13 as compared with the charged level of the toner in the developing mode. As a consequence, the potential difference between the toner supply roller 12 and the toner on the developing roller 13 is greater than the potential difference between the developing roller 13 and the toner supply roller 12.

In the toner cleaning mode, the toner supply roller 12 is connected to ground. The blade bias applied to the thickness regulating blade 14 has an absolute value greater than that of the developing bias applied to the developing roller 13. As a consequence, the potential difference between the thickness regulating blade 14 and the toner supply roller 12 is greater than the potential difference between the developing roller 13 and the supply roller 12.

As described before, the thickness regulating blade 14 also operates as a charging member for charging the toner. Therefore, provision of an independent toner charging member is not required, thereby reducing the number of components making up the laser printer 1.

The thickness regulating blade 14 according to this embodiment is made of metal and thus has a smaller electrical resistance than a conventional thickness regulating blade made of an electrically conductive rubber. Thus, application of the bias to the toner on the developing roller 13 can be more effectively carried out with the use of thickness regulating blade 14 made of metal.

The toner supply roller 12 rotates in the opposite direction with respect to the developing roller 13 while contacting each other at their peripheries. The slidable contact of the toner supply roller 12 with the developing roller 13 yields a great deal of friction at the contacting area. In addition to the electrostatic attracting force imparted upon the toner which causes the toner to be attracted on the toner supply roller 12, the friction acts upon the toner held on the developing roller 13 to remove from the developing roller 13. As a consequence, removal of the toner from the developing roller 13 and collection of the removed toner on the toner supply roller 12 can be more effectively accomplished.

The additive deposited on the surface of the toner may be made from a material that is charged to a polarity opposite to the toner. Silica and the titanium oxide are the examples of such additive. When the toner and the additive are charged to opposite polarities, the additive is liable to be peeled off and separated from the toner. While the toner on the developing roller 13 is removed therefrom, the additive may keep on staying on the developing roller 13. In order to remove not only the toner but also the additive from the toner supply roller 12, the bias circuit 30 applies relevant bias voltages to the developing roller 13, toner supply roller 12 and thickness regulating blade 14 when the laser printer is operating in the toner cleaning mode. The additive separated from the toner and remaining on the developing roller 13 is scratched by the toner supply roller 12 at the portion where the developing roller 13 and the toner supply roller 12 are in slidable contact with each other. Adhesion of the additive to the peripheral surface of the developing roller 13, which phenomenon being known as "filming", can be prevented from occurring.

While the invention has been described in detail with reference to the embodiment thereof, it would be apparent to those skilled in the art that various changes and modifications may be made therein without departing from the spirit of the invention.

In the above-described embodiment, the toner supply roller 12 is described as being connected to ground by the operation of the bias circuit 30 in the toner cleaning mode. However, modification may be made so as to apply bias voltage of 0 V to the toner supply roller 12 in the developing mode, and apply bias voltage of positive or negative polarity to the toner supply roller 12 in the toner cleaning mode.

What is claimed is:

1. An image forming apparatus comprising:

a photosensitive member having a surface on which a latent image is formable;

a developing roller having a surface on which toner is held, the toner being made of a single-component non-magnetic material;

a toner supply roller that is disposed in contact with the developing roller, the toner supply roller being configured to supply the toner to the developing roller in a developing mode wherein the developing roller develops the latent image with the toner held on the developing roller, the toner supply roller being configured to remove the toner from the developing roller in a toner cleaning mode wherein the toner supply roller removes the toner held on the developing roller;

a charging member configured to charge the toner held on the developing roller to a first polarity;

a bias circuit configured to apply bias voltages to the developing roller, the toner supply roller, and the charging member; and a controller configured to control the bias circuit to produce the bias voltages such that a potential difference between the charging member and the toner supply roller is greater than a potential difference between the developing roller and the toner supply roller in the toner cleaning mode, such that a potential difference between the developing roller and the toner supply roller in the cleaning mode is greater than a potential difference between the developing roller and the toner supply roller in the developing mode, and that a potential difference between the charging member and the toner supply roller in the cleaning mode is greater than a potential difference between the charging roller and the toner supply roller in the developing mode.

2. The image forming apparatus according to claim 1, wherein in the developing mode, the controller is further configured to control the bias circuit to apply a predetermined bias voltage to the developing roller, the predetermined bias voltage being a second polarity opposite the first polarity, wherein in the toner cleaning mode, the controller is further configured to control the bias circuit so that the bias voltages applied to the developing roller and the charging member are the second polarity, and that a first bias voltage applied to the charging member is greater in absolute value than a second bias voltage applied to the developing roller, and the second bias voltage is greater in absolute value than a third bias voltage applied to the supply roller.

3. The image forming apparatus according to claim 2, wherein the controller is further configured to control the bias circuit so that the predetermined bias voltage is applied to the developing roller in the toner cleaning mode.

4. The image forming apparatus according to claim 3, wherein the controller is further configured to control the bias circuit so that the supply roller is connected to ground in the toner cleaning mode.

5. The image forming apparatus according to claim 1, wherein the charging member is in contact with the developing roller to regulate thickness of the toner on the developing roller.

6. The image forming apparatus according to claim 5, wherein the charging member is made from metal.

7. The image forming apparatus according to claim 1, wherein the supply roller and the developing roller are driven to rotate in same direction.

8. The image forming apparatus according to claim 1, wherein the developer is further made of an additive for improving fluidity of the single-component non-magnetic toner particle.

9. The image forming apparatus according to claim 8, the additive is made from silicon.

10. The image forming apparatus according to claim 8, wherein the additive is made from titanium oxide.

11. The image forming apparatus according to claim 1, wherein the potential of the developing roller in the cleaning mode is the same as the potential of the developing roller in the cleaning mode.

12. The image forming apparatus according to claim 1, wherein the potential of the developing roller is the same as the potential of the toner supply roller in the developing mode.

* * * * *